US008171699B2

(12) United States Patent
Secor

(10) Patent No.: US 8,171,699 B2
(45) Date of Patent: May 8, 2012

(54) ANTI-FATIGUE FLOORING SYSTEM

(75) Inventor: Thomas E. Secor, Willard, OH (US)

(73) Assignee: Durable Corporation, Norwalk Park, OH (US)

( * ) Notice: Subject to any disclaimer, the term of this patent is extended or adjusted under 35 U.S.C. 154(b) by 39 days.

(21) Appl. No.: 12/709,564

(22) Filed: Feb. 22, 2010

(65) Prior Publication Data

US 2011/0203208 A1 Aug. 25, 2011

(51) Int. Cl.
*E04B 1/00* (2006.01)

(52) U.S. Cl. ..... 52/745.06; 52/177; 52/403.1

(58) Field of Classification Search ..... 52/403.1, 52/177, 309.1, 309.4, 459, 747.1, 747.11, 52/745.06

See application file for complete search history.

(56) References Cited

U.S. PATENT DOCUMENTS

| | | | | |
|---|---|---|---|---|
| 4,945,697 | A | 8/1990 | Ott et al. | |
| 5,645,914 | A * | 7/1997 | Horowitz | 428/81 |
| 5,683,780 | A | 11/1997 | Rodger et al. | |
| 5,766,726 | A * | 6/1998 | Bannister | 428/119 |
| 6,599,599 | B1 * | 7/2003 | Buckwater et al. | 428/40.1 |
| 6,673,177 | B2 * | 1/2004 | Buckwalter et al. | 156/71 |
| 6,920,723 | B2 * | 7/2005 | Downey | 52/144 |
| 6,921,502 | B1 | 7/2005 | Nord et al. | |
| 7,096,631 | B1 * | 8/2006 | Counihan | 52/403.1 |
| 7,121,052 | B2 * | 10/2006 | Niese et al. | 52/403.1 |
| 7,174,682 | B2 * | 2/2007 | Pelosi, Jr. | 52/179 |
| 7,690,160 | B2 * | 4/2010 | Moller, Jr. | 52/177 |
| 7,770,336 | B2 * | 8/2010 | Jaekel | 52/65 |
| 2006/0165950 | A1 * | 7/2006 | Dodge | 428/90 |

OTHER PUBLICATIONS

Discount Floor Mat Store, "Marbleized Tile Top—Anti-Fat. Floor Mats for H. D. Service", www.floormat-store.com/industrial-mats/marble-sof-tyle, printed Oct. 2, 2009, 3 pages.

Durable Corporation, "Grand Stand HD Industrial Mats", www.durablecorp.com/mats-flooring/anti-fatigue, printed Oct. 20, 2009, 3 pages.

* cited by examiner

*Primary Examiner* — William Gilbert
*Assistant Examiner* — Gisele Ford
(74) *Attorney, Agent, or Firm* — Porter, Wright, Morris & Arthur, LLP

(57) ABSTRACT

An anti-fatigue flooring system includes at least one anti-fatigue area adjacent a work station in a room. The anti-fatigue area includes an anti-fatigue member of a resilient foam material and transition members located about the anti-fatigue member. Flooring extends over the anti-fatigue member and the transition members so that the anti-fatigue member and the transition members are located between the flooring and the subfloor. The transition members transition the flooring from the top of the anti-fatigue member down to the subfloor located about the transition members. The flooring is preferably secured to the top of the anti-fatigue member, the top of the transition members, and the subfloor about the anti-fatigue area.

41 Claims, 5 Drawing Sheets

ANTI-FATIGUE FLOORING SYSTEM

CROSS-REFERENCE TO RELATED APPLICATIONS

Not Applicable

STATEMENT REGARDING FEDERALLY SPONSORED RESEARCH

Not Applicable

REFERENCE TO APPENDIX

Not Applicable

FIELD OF THE INVENTION

The field of the present invention generally relates to floor covering systems and, more particularly, to anti-fatigue flooring systems having imbedded cushioning material rather than anti-fatigue mats located on top of floor covering.

BACKGROUND OF THE INVENTION

There is a distinct relationship between comfort, safety, and productivity in the workplace. When workers are required to stand for long periods of time, worker discomfort and fatigue can impact productivity and absenteeism. In order to reduce this problem, anti-fatigue mats have been utilized when the worker stands for long periods of time at one location. These anti-fatigue mats lie on top of the floor covering and provide a resilient cushioned surface that alleviates pressure to stimulate blood and oxygen flow to the lower body which reduces muscle fatigue. The result is improved worker morale and productivity.

While these anti-fatigue mats can be effective at improving worker morale and productivity, they make it difficult to clean the floor such as sweeping and vacuuming, as well as creating tripping hazards. Accordingly, there is a need in the art for an improved anti-fatigue flooring system which provides the increased comfort, safety and productivity provided by the mats but without the inconveniences of the mats.

SUMMARY OF THE INVENTION

Disclosed are anti-fatigue flooring systems which address one or more issues of the related art. One disclosed embodiment of an anti-fatigue flooring system comprises, in combination, at least one anti-fatigue member comprising a resilient foam material and flooring extending over the anti-fatigue member and about the anti-fatigue member. The resilient foam material provides cushioning that produces an anti-fatigue effect. The flooring is secured to the subfloor about the anti-fatigue member.

Another disclosed embodiment of an anti-fatigue flooring system comprises, in combination, an anti-fatigue member comprising a resilient foam material for placement between flooring and a subfloor and transition members for placement between the flooring and the subfloor about the anti-fatigue member to transition the flooring from a top surface of the anti-fatigue member down to the subfloor located about the transition members. The resilient foam material provides cushioning that produces an anti-fatigue effect. The flooring is secured to the subfloor about the anti-fatigue member.

Further disclosed herein is a method of installing an anti-fatigue flooring system on a subfloor comprising, in combination, placing an anti-fatigue member comprising a resilient foam material on the subfloor, extending flooring over the anti-fatigue member and about the anti-fatigue member, and securing the flooring to the subfloor about the anti-fatigue member.

From the foregoing disclosure and the following more detailed description of various preferred embodiments it will be apparent to those skilled in the art that the present invention provides a significant advance in the technology and art of anti-fatigue flooring systems. Particularly significant in this regard is the potential the invention affords for providing a high quality, reliable, anti-fatigue flooring system which is easy to maintain and reduces tripping. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
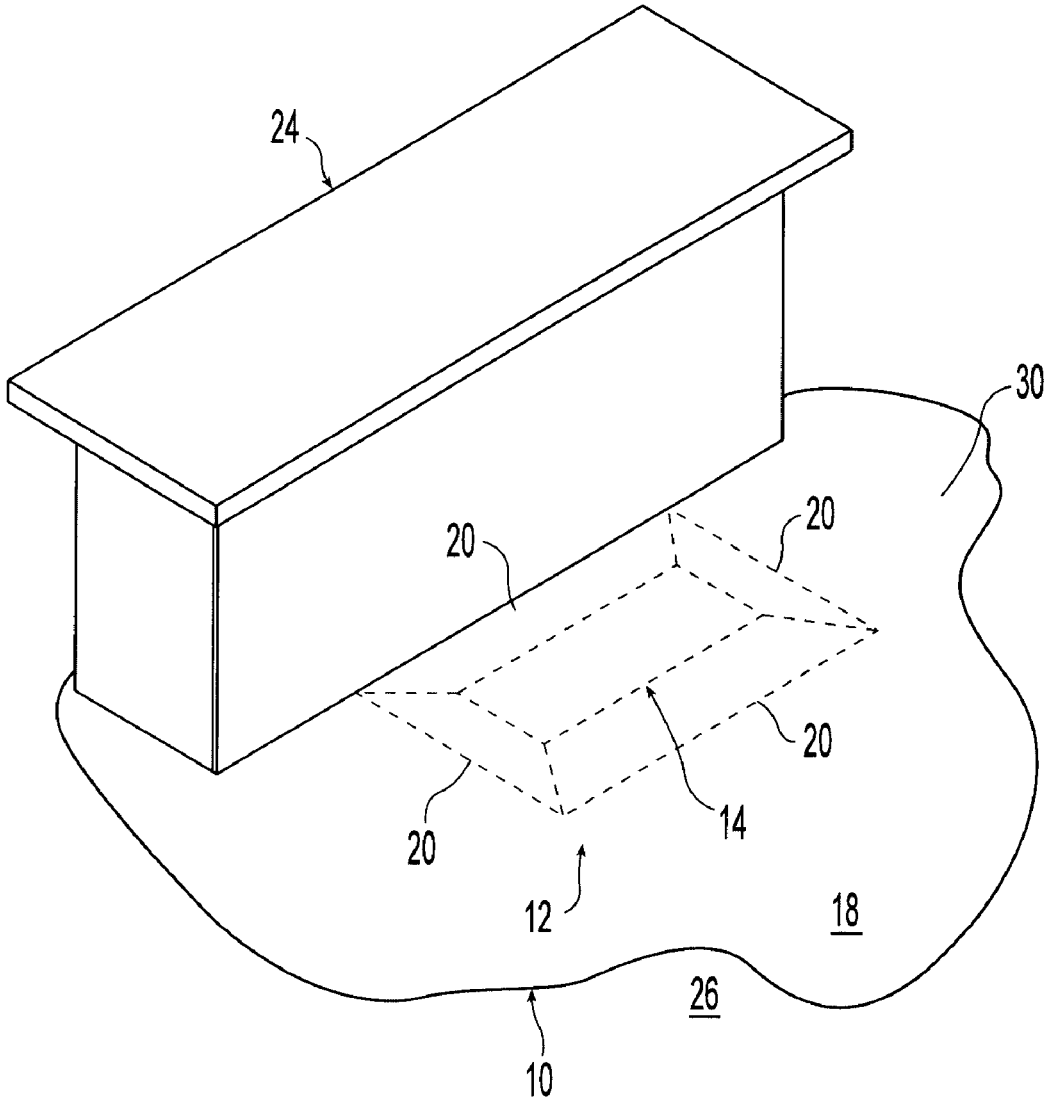
FIG. 1 is a perspective view of an anti-fatigue flooring system according to a preferred embodiment of the present invention, wherein an anti-fatigue area is located at a work station.
Figure 2:
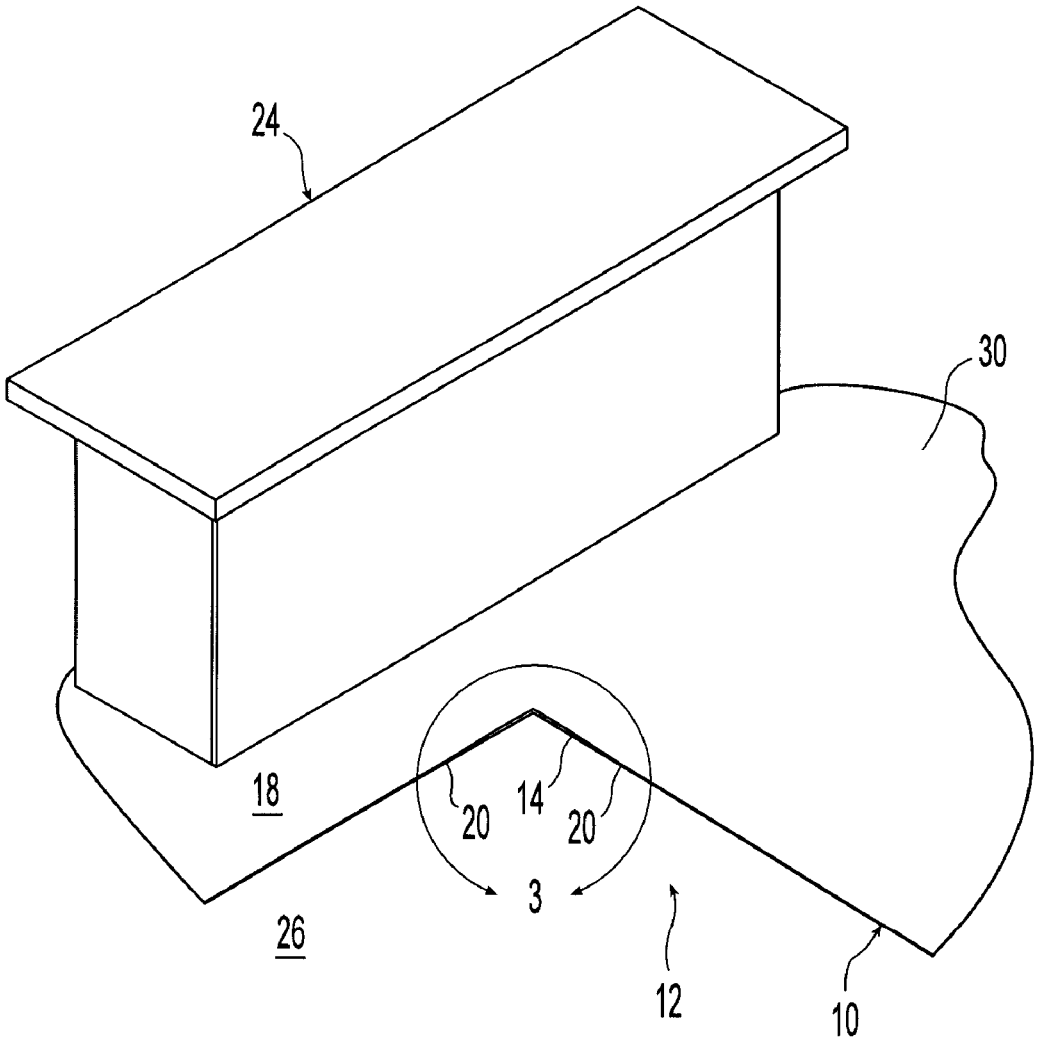
FIG. 2 is a sectional perspective view of the anti-fatigue flooring system of FIG. 1, wherein the anti-fatigue area is sectioned.
Figure 3:
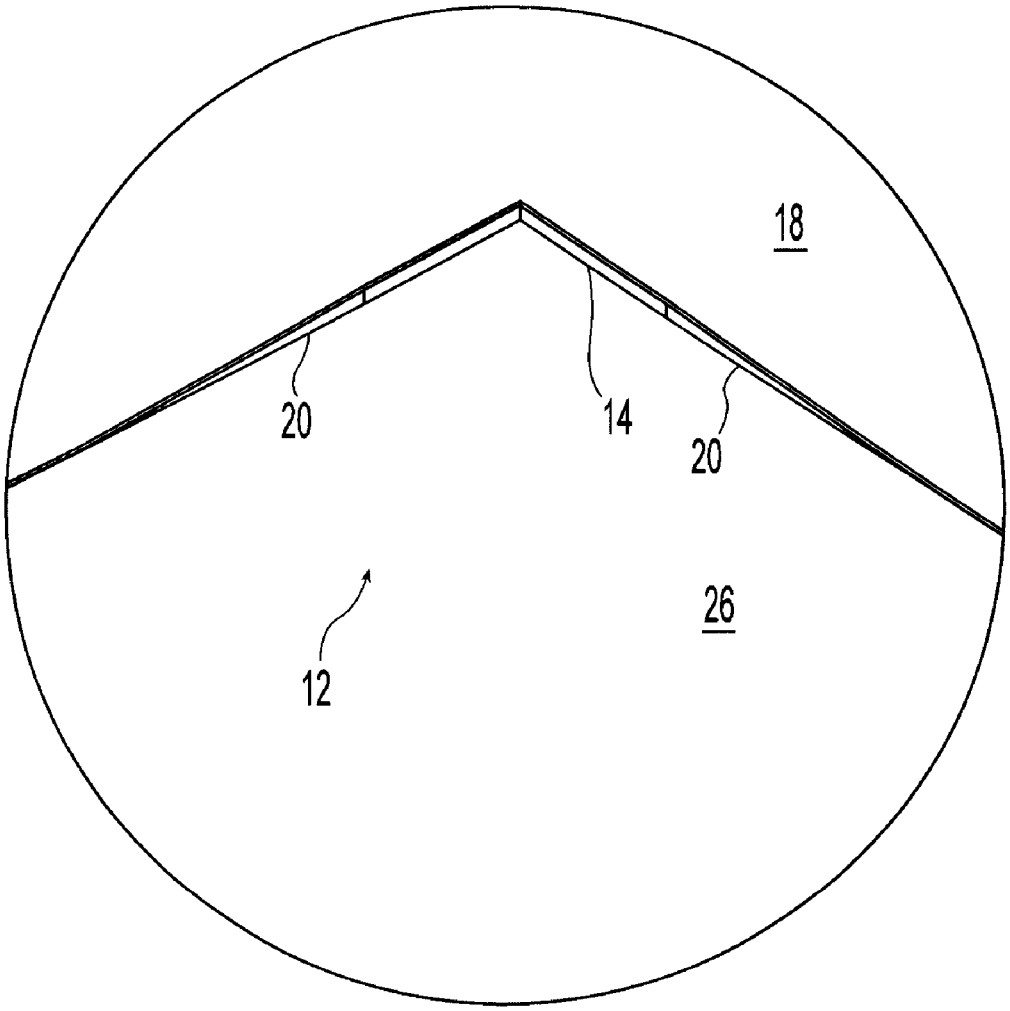
FIG. 3 is an enlarged, fragmented perspective view of the sectioned portion of FIG. 2.
Figure 4:
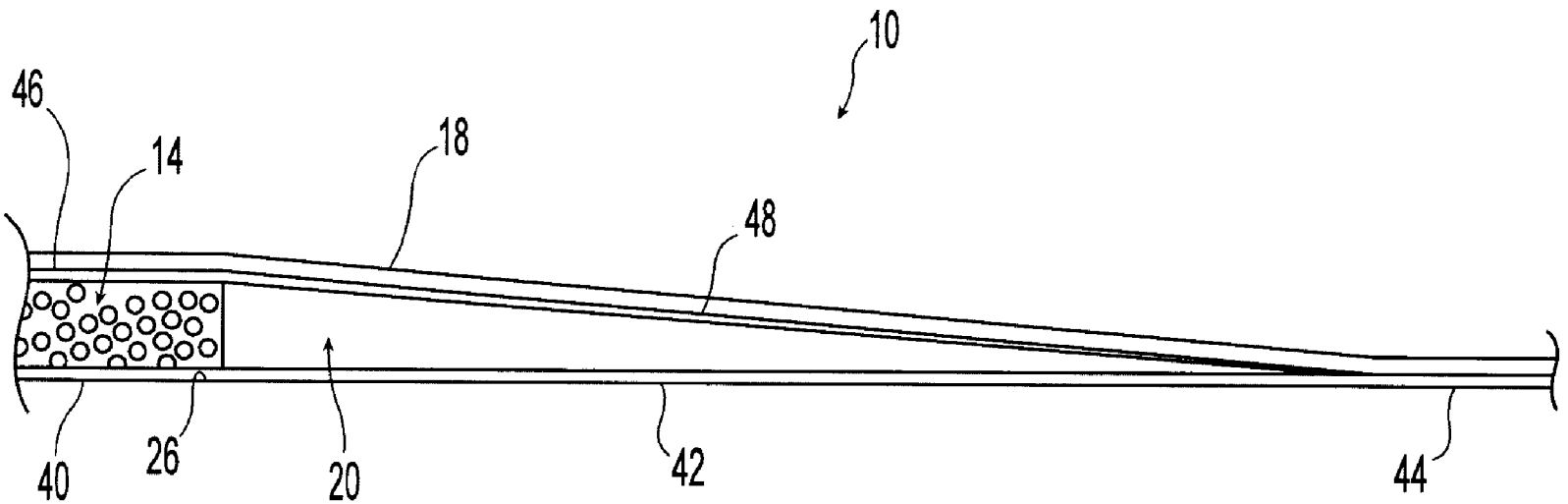
FIG. 4 is a fragmented cross-sectional view of an ant-fatigue member abutted by a transition member of the anti-fatigue flooring system of FIGS. 1 to 3.

It should be understood that the appended drawings are not necessarily to scale, presenting a somewhat simplified representation of various preferred features illustrative of the basic principles of the invention. The specific design features of the anti-fatigue flooring systems as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the insulated carriers illustrated in the drawings. In general, up or upward generally refers to an upward direction within the plane of the paper in FIG. 4 and down or downward generally refers to a downward direction within the plane of the paper in FIG. 4.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved anti-fatigue flooring systems disclosed herein. The following detailed discussion of various alternative and preferred embodiments will illustrate the general principles of the invention. Other embodiments suitable for other applications will be apparent to those skilled in the art given the benefit of this disclosure.

Referring now to the drawings, FIGS. 1 to 4 show an anti-fatigue flooring system 10 according to the present invention installed on a subfloor 26. The term "subfloor" is used in this specification and claims to mean floor structure supporting and underlying visible flooring or other floor coverings. The terms "flooring" or "floor covering" are used in this specification and claims to mean finishing material installed over a subfloor that is visible and comes in contact with your feet when you walk across a room. A finished floor comprises flooring installed over a subfloor.

The illustrated anti-fatigue flooring system 10 includes at least one anti-fatigue area 12 comprising an anti-fatigue member or piece 14 and adjacent transition members or pieces 20. Common off-the shelf floor covering or flooring 18 extends over and covers the anti-fatigue member 14 and the transition members 20 and also the subfloor 26 about the anti-fatigue area 12. The anti-fatigue area 12 is positioned at a work station 24 where a worker spends long periods of time standing. The illustrated work station 24 includes a counter but any other suitable type of work station can be utilized such as, for example, desks, tables, cashier stations, chairs, beds, conveyor belts, and the like. While the illustrated embodiment illustrates a single anti-fatigue area 12 adjacent a single work station 24, it is apparent that there can be more than one anti-fatigue area 12 per work station 24 and/or there can be more than one work station 24 within the scope of the present invention. In fact, most applications will have more than one anti-fatigue area 12.

The illustrated anti-fatigue member 14 is generally rectangular shaped having a generally flat or planar and horizontally-oriented top surface, a generally flat or planar and horizontally-oriented bottom surface, and generally flat or planar and vertically-oriented side surfaces connecting the top and bottom surface. It is noted that the anti-fatigue member 14 can alternatively have other shapes depending on the type of work station 24 it is associated with. For example, the anti-fatigue member 14 can form an annular shape to encircle a salon chair.

The anti-fatigue member 14 is preferably comprises a resilient foam material such as, for example, foamed rubber, foamed vinyl, or the like. However, the anti-fatigue member can alternatively comprise any other suitable material or combination of materials that provides cushioning to produce an anti-fatigue effect. The anti-fatigue member 14 generally has a thickness in the range from about 0.25 inches to about 0.5 inches, but may dictate a wider variation of thicknesses such as, for example from 0.5 inches to 1.0 inches. The anti-fatigue member 14 has a length and width sized to provide a desired area for the anti-fatigue area 12. It is noted that generally the area of the flooring 18 at the anti-fatigue area 12 is substantially smaller than the area of the flooring 18 over the remainder of the subfloor 26 in the room.

Figure 5:
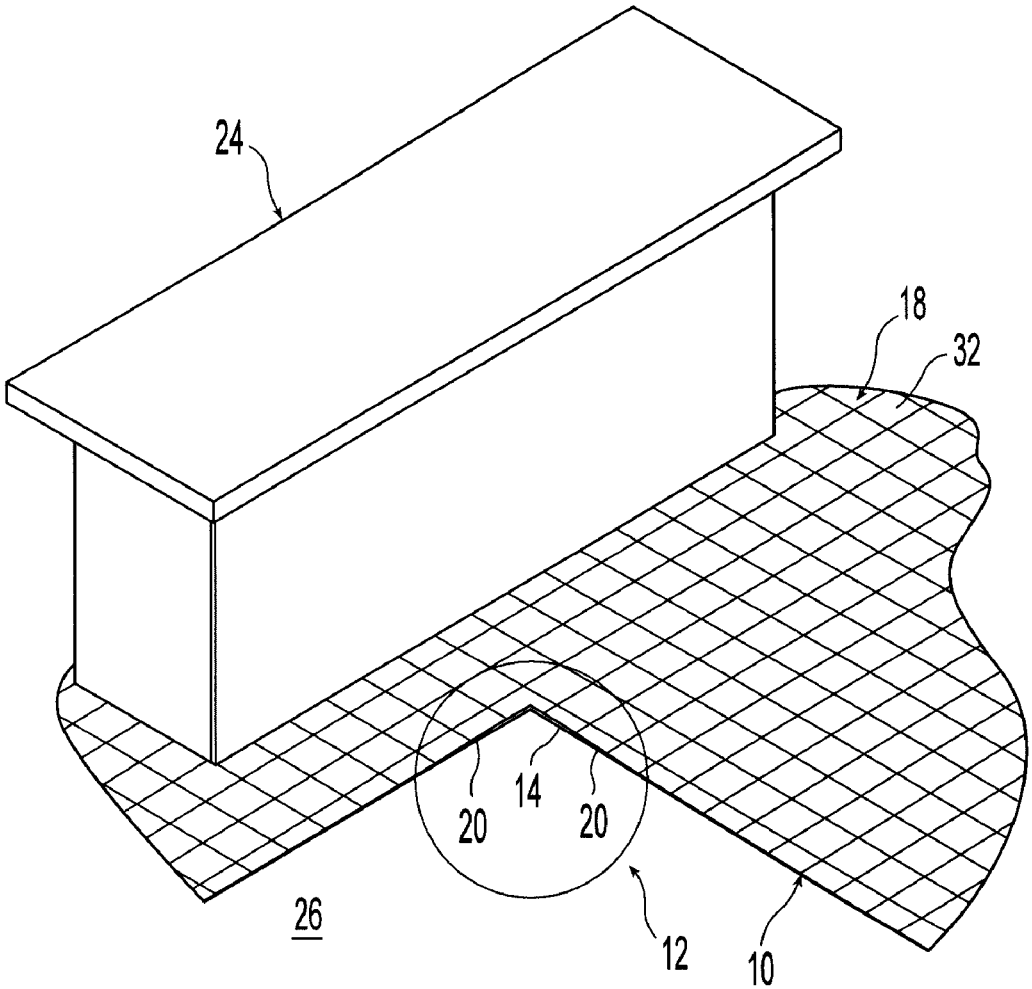
FIG. 5 a perspective view of another anti-fatigue flooring system according to a preferred embodiment of the present invention, utilizing tile squares as the flooring.

The floor covering or flooring 18 can be of any suitable type that is flexible enough to extend over the anti-fatigue member 14 and the adjacent transition members 20. The flooring 18 can be any commonly available off-the-shelf carpeting, vinyl flooring, and the like. The flooring 18 can be in the form of a single web or sheet 30 (best shown in FIG. 1) or a plurality of square or other shaped tiles 32 (best shown in FIG. 5).

The illustrated transition members or pieces 20 are located between the flooring 18 and the subfloor 26 about the periphery of the anti-fatigue member 14 to transition the flooring 18 from the top surface of the anti-fatigue member 14 to the subfloor 26 located about the transition members 20. The transition members 20 prevent a sharp step from forming in the flooring 18 and/or a gap forming between the flooring 18 and the subfloor 26. The illustrated transition members 20 are in the shape of wedges having a generally flat or planer and horizontally-oriented bottom surface for placement on the subfloor 26, a generally flat or planer and vertically-oriented rear surface for abutment against the side surfaces of the anti-fatigue member 14, and an angled or inclined top surface that extends downwardly from a rearward edge located at the top surface of the anti-fatigue member 14 to a forward edge located at the subfloor 26. While the illustrated upper surface is generally flat or planar, it can alternatively be curved or any other suitable shape that will provide a generally smooth transition. The rearward height of the transition members 20 is generally the same height of the anti-fatigue member 14, while the forward height of the transition members 20 is generally approaching zero height. The width of the transition members 20 is of any suitable width that provides a smooth transition from the top surface of the anti-fatigue member 14 to the subfloor 26. In general, a taller anti-fatigue member 14 and/or a less flexible flooring 18, requires wider transition members 20 to provide a smooth transition. It is believed that a width of at least about 6 inches for the transition members 20 is required for anti-fatigue member 14 having a height of about 0.5 inches or greater. The transition members 20 should have an adequate length so that they collectively extend entirely around the anti-fatigue member 14. The illustrated embodiment includes four transition members 20 that have lengths that match the side surfaces of the anti-fatigue member 14 and are mitered at the corners. It is noted that a greater or lesser quantity of transition members 20 can be utilized. It is additionally noted that relatively small gaps can be located between the transition members 20 if desired. The illustrated transition members 20 are formed as separate components from the anti-fatigue member 14 so that custom installations can be easily achieved.

The transition members 20 can be of any suitable material such as, for example, rubber, vinyl, or the like. It is noted that the transition members 20 are preferably formed of a material that provides ease of transition for someone walking onto and off of the anti-fatigue area 12 rather than providing an anti-fatigue effect. Therefore, the material of the transition members 20 preferably has less cushioning and/or is harder than the resilient foam material of the anti-fatigue member 14.

The anti-fatigue member 14 is positioned on top of the subfloor 26 at the work station 24. The anti-fatigue member 14 can be secured to the subfloor 26 in any suitable manner such as, for example, a layer of adhesive 40 (best shown in FIG. 4). Alternatively, the anti-fatigue member 14 can lay freely on the subfloor 26 to be secured in place by the flooring 18. The transition members 20 are positioned on top of the subfloor 26 about the periphery of the anti-fatigue member 14. The transition members 20 can be secured to the subfloor 26 in any suitable manner such as, for example, a layer of adhesive 42 (best shown in FIG. 5). Alternatively, the transition members 20 can lay freely on the subfloor 26 to be secured in place by the flooring 18. The flooring 18 is then placed over the anti-fatigue member 14 and the transition members 20 and onto the subfloor 26 about the anti-fatigue area 12. The flooring 18 can be secured to the subfloor 26 in any suitable manner such as, for example, a layer of adhesive 44 (best shown in FIG. 4). The flooring 18 can also be secured to the anti-fatigue member 14 and/or the transition members 20 in any suitable manner such as, for example, a layer of adhesive 46, 48 (best shown in FIG. 4). It is noted that while the illustrated embodiment utilizes continuous layers 40, 42, 46, 48 of the same adhesive, the layers can alternatively be separate and/or of different adhesives. Installed in this manner, a worker can stand of the anti-fatigue area 12 and obtain the benefit of cushioning effect of the anti-fatigue member 14 while the remainder of the flooring 18 about the anti-fatigue area 12 retains it common ordinary feel. That is, the anti-fatigue area 12 has a substantially greater cushioning effect than the remainder of the flooring 18.

It is noted that each of the features and variations of the above-described embodiments of the invention can be used in any combination with any of the other above-described embodiments.

It is apparent from the above detailed description of preferred embodiments of the present invention, that anti-fatigue flooring systems 10 of the present invention provide the benefits of ant-fatigue mats while providing an anti-fatigue flooring system 10 that is easier to clean, is less likely to create tripping points for the worker, has a reduced chance of damage, destruction or theft, and has a more pleasing appearance.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A method of installing an anti-fatigue flooring system on a subfloor at a work station where a worker spends long periods of time standing, said method comprising, in combination:

placing an anti-fatigue member comprising a resilient foam material on a subfloor at a workstation and covering only a portion of the subfloor;

covering the subfloor about the anti-fatigue member with flexible flooring and extending the flexible flooring over the anti-fatigue member to cover the anti-fatigue member with the flexible flooring;

wherein the flexible flooring bends as it transitions between the portion of the subfloor not covered by the anti-fatigue member and the portion of the subfloor covered by the anti-fatigue member to provide a smooth transition over the anti-fatigue member;

wherein a portion of the flexible flooring that is extending over and covering the anti-fatigue member is in the form of a flexible flooring sheet;

securing the flexible flooring sheet directly to a top of the anti-fatigue member; and securing the flexible flooring to the subfloor about the anti-fatigue member with an adhesive.

2. The method according to claim 1, further comprising placing transition members on the subfloor about the anti-fatigue member to transition the flexible flooring from a top of the anti-fatigue member to the subfloor located about the transition members and extending the flexible flooring over both the anti-fatigue member and the transition members.

3. The method according to claim 1, further comprising the step of directly securing the flexible flooring sheet to the top of the anti-fatigue member with adhesive.

4. The method according to claim 3, further comprising the step of directly securing a bottom of the anti-fatigue member is to the subfloor with adhesive.

5. The method according to claim 1, wherein the flexible flooring comprises a plurality of tiles.

6. The method according to claim 1, wherein the flexible flooring comprises vinyl flooring material.

7. The method according to claim 1, wherein the flexible flooring comprises rubber flooring material.

8. The method according to claim 1, wherein the flexible flooring comprises carpet flooring material.

9. An anti-fatigue flooring system for installation on a subfloor at a work station where a worker spends long periods of time standing, said system comprising, in combination:

at least one anti-fatigue member comprising a resilient foam material providing cushioning to produce an anti-fatigue effect located at a workstation and covering only a portion of a subfloor;

flexible flooring covering the subfloor about the anti-fatigue member and extending over the anti-fatigue member to cover the anti-fatigue member;

wherein a portion of the flexible flooring that is extending over and covering the anti-fatigue member is in the form of a flexible flooring sheet and the flexible flooring sheet is secured directly to a top of the anti-fatigue member;

wherein the flexible flooring is secured to the subfloor about the anti-fatigue member with an adhesive; and wherein the flexible flooring bends as it transitions between the portion of the subfloor not covered by the anti-fatigue member and the portion of the subfloor covered by the anti-fatigue member to provide a smooth transition over the anti-fatigue member and the surrounding subfloor.

10. The anti-fatigue flooring system according to claim 9, wherein a bottom of the anti-fatigue member is directly secured to the subfloor with adhesive.

11. The anti-fatigue flooring system according to claim 9, wherein the flexible flooring sheet is directly secured to the top of the anti-fatigue member with adhesive.

12. The anti-fatigue flooring system according to claim 9, wherein the flexible flooring comprises vinyl flooring material.

13. The anti-fatigue flooring system according to claim 9, wherein the resilient foam material comprises rubber.

14. The anti-fatigue flooring system according to claim 9, wherein the resilient foam comprises vinyl.

15. The anti-fatigue flooring system according to claim 9, wherein the anti-fatigue member has a thickness in the range of 0.25 inches to 0.5 inches.

16. The anti-fatigue flooring system according to claim 9, wherein the anti-fatigue member has a thickness in the range of about 0.5 inches to about 1.0 inches.

17. The anti-fatigue flooring system according to claim 9, further comprising transition members located below the flexible flooring and about the anti-fatigue member to transition the flooring from a top of the anti-fatigue member to the subfloor located about the transition members.

18. The anti-fatigue flooring system according to claim 17, wherein the transition members comprise rubber.

19. The anti-fatigue flooring system according to claim 17, wherein the transition members comprise vinyl.

20. The anti-fatigue flooring system according to claim 17, wherein the transition members are wedge shaped.

21. The anti-fatigue flooring system according to claim 17, wherein the transition members extend entirely about the anti-fatigue member.

22. The anti-fatigue flooring system according to claim 17, wherein bottoms of the transition members are directly secured to the subfloor with adhesive.

23. The anti-fatigue flooring system according to claim 17, wherein the flexible flooring is directly secured to a top of the transition members with adhesive.

24. The anti-fatigue flooring system according to claim 17, wherein the transition members are formed as separate components from the anti-fatigue member.

25. The anti-fatigue flooring system according to claim 9, wherein the anti-fatigue member covers a substantially smaller portion of the subfloor than the flooring.

26. The anti-fatigue flooring system according to claim 9, wherein the flexible flooring comprises a plurality of tiles.

27. The anti-fatigue flooring system according to claim 9, wherein the flexible flooring comprises rubber flooring material.

28. The anti-fatigue flooring system according to claim 9, wherein the flexible flooring comprises carpet flooring material.

29. An anti-fatigue flooring system for installation on a subfloor at a work station where a worker spends long periods of time standing, said system comprising, in combination:

flexible flooring;

an anti-fatigue member comprising a resilient foam material placed between the flexible vinyl flooring and a subfloor at a workstation and covering only a portion of the subfloor;

wherein the resilient foam material provides cushioning to produce an anti-fatigue effect as the worker stands on the anti-fatigue member;

transition members for placement between the flexible flooring and the subfloor about the anti-fatigue member to transition the flexible flooring from a top of the anti-fatigue member to the subfloor located about the transition members;

wherein the flexible flooring covers the subfloor about the anti-fatigue member and extends over the transition members and the anti-fatigue member to cover the anti-fatigue member;

wherein a portion of the flexible flooring that is extending over and covering the anti-fatigue member is in the form of a flexible flooring sheet and the flexible flooring sheet is secured directly to a top of the anti-fatigue member;

wherein the flexible flooring is directly secured to the subfloor about the anti-fatigue member; and wherein the flexible flooring bends as it transitions between the portion of the subfloor not covered by the anti-fatigue member and the portion of the subfloor covered by the anti-fatigue member to provide a smooth transition over the anti-fatigue member and the surrounding subfloor.

30. The anti-fatigue flooring system according to claim 29, wherein the transition members are wedge shaped.

31. The anti-fatigue flooring system according to claim 29, wherein the transition members extend entirely about the anti-fatigue member.

32. The anti-fatigue flooring system according to claim 29, wherein the transition members are formed as separate components from the anti-fatigue member.

33. The anti-fatigue flooring system according to claim 29, wherein the transition members comprise rubber.

34. The anti-fatigue flooring system according to claim 29, wherein the transition members comprise vinyl.

35. The anti-fatigue flooring system according to claim 29, wherein the transition members comprise a material harder than the resilient foam material of the anti-fatigue member.

36. The anti-fatigue flooring system according to claim 29, wherein the flexible flooring sheet is directly secured to the top of the anti-fatigue member with adhesive and wherein the flexible flooring sheet is directly secured to a top of the transition members with adhesive.

37. The anti-fatigue flooring system according to claim 36, wherein a bottom of the anti-fatigue member is directly secured to the subfloor with adhesive and wherein a bottom of the transition members are directly secured to the subfloor with adhesive.

38. The anti-fatigue flooring system according to claim 29, wherein the flexible flooring comprises vinyl flooring material.

39. The anti-fatigue flooring system according to claim 29, wherein the flexible flooring comprises rubber flooring material.

40. The anti-fatigue flooring system according to claim 29, wherein the flexible flooring comprises carpet flooring material.

41. The anti-fatigue flooring system according to claim 29, wherein the flexible flooring comprises a plurality of tiles.

* * * * *